US007322533B2

(12) United States Patent
Grizzle

(10) Patent No.: US 7,322,533 B2
(45) Date of Patent: Jan. 29, 2008

(54) ROTARY STREAM SPRINKLER WITH ADJUSTABLE DEFLECTOR RING

(76) Inventor: Glendale Grizzle, 37824 Sky High Dr., Murrieta, CA (US) 92562

( * ) Notice: Subject to any disclaimer, the term of this patent is extended or adjusted under 35 U.S.C. 154(b) by 293 days.

(21) Appl. No.: 11/069,842

(22) Filed: Feb. 28, 2005

(65) Prior Publication Data

US 2006/0192029 A1 Aug. 31, 2006

(51) Int. Cl.
*B05B 15/10* (2006.01)

(52) U.S. Cl. ..... 239/204; 239/206; 239/210; 239/222.17; 239/263.3; 239/222.11

(58) Field of Classification Search ..... 239/203, 239/204, 202, 210, 222.11, 222.17, 222.19, 239/251, 252, 259, DIG. 1
See application file for complete search history.

(56) References Cited

U.S. PATENT DOCUMENTS 1,764,570 A 6/1930 Lohman
2,493,595 A 1/1950 Rieger
2,909,325 A * 10/1959 Hunter ..... 239/97
3,854,664 A 12/1974 Hunter
3,934,820 A * 1/1976 Phaup ..... 239/205
4,353,506 A * 10/1982 Hayes ..... 239/206
4,471,908 A 9/1984 Hunter
4,501,391 A * 2/1985 Hunter ..... 239/97
4,625,914 A * 12/1986 Sexton et al. ..... 239/206
4,815,662 A 3/1989 Hunter
4,842,201 A 6/1989 Hunter
4,867,379 A 9/1989 Hunter
4,932,590 A 6/1990 Hunter
4,967,961 A 11/1990 Hunter
4,971,250 A 11/1990 Hunter
5,226,602 A 7/1993 Cochran et al.
6,651,905 B2 11/2003 Sesser et al.

* cited by examiner

*Primary Examiner*—Dinh Q. Nguyen
(74) *Attorney, Agent, or Firm*—Michael H. Jester

(57) ABSTRACT

A sprinkler includes a riser having an inlet end and an outlet end. A nozzle is rotatably supported at the outlet end of the riser and has a plurality of circumferentially spaced, radially extending stream forming slots. An orifice member is removably mounted adjacent the outlet end of the riser and has an orifice shaped to deliver water flowing through the riser into the stream forming slots in a manner that produces a predetermined water distribution pattern. A rotatably adjustable deflector ring is configured and mounted for intercepting streams of water ejected from the stream forming slots to vary a reach thereof.

18 Claims, 8 Drawing Sheets

ROTARY STREAM SPRINKLER WITH ADJUSTABLE DEFLECTOR RING

FIELD OF THE INVENTION

The present invention relates to commercial and residential irrigation systems for watering turf and other landscaping, and more particularly, to sprinklers used with such systems.

BACKGROUND OF THE INVENTION

Modern residential and commercial irrigation systems include subterranean plastic branch pipes that each feed water to multiple sprinklers mounted on risers. Pressurized water is fed to the branch pipes via solenoid actuated values which are energized by an electronic irrigation controller. The controller executes a watering program consisting of pre-programmed run and cycle times for all of the sprinklers on each of the branch pipes, which are collectively referred to as a station.

The sprinklers that are used in residential and commercial irrigation systems fall into several basic categories. Spray-type sprinklers are used for close-in watering and project a fan-shaped pattern of water which is either full circle or some division thereof, e.g. ninety degrees. Adjustable arc spray nozzles have also been used for many years. Rotor-type sprinklers are used where large area coverage is desired and typically eject from a nozzle a single, relatively robust inclined stream of water as much as sixty feet or more. The nozzle is oscillated through an adjustable arc utilizing turbine, gear reduction and reversing mechanisms. Rotor-type sprinklers often have replaceable nozzles to vary the precipitation rate, i.e. gallons per minute (GPM), of the sprinkler. Some rotor-type sprinklers used on golf courses have built-in valves. Rotary stream sprinklers simultaneously eject a plurality of smaller inclined streams of water. They are useful in applications where more coverage is needed than can be provided by a spray-type sprinkler, and usually less than that provided by a large rotor-type sprinkler. They also eject an aesthetically pleasing array of slowly moving water streams. A modern rotary stream sprinkler has a pop-up riser with an inverted frusto-conical distributor head. Water is channeled upwardly through a flow-adjustable orifice and impinges on the underside of the distributor head. The distributor head has spiral grooves that form the rotary streams. A viscous damper mechanism ensures that the distributor head turns slowly so that the reach of the multiple streams is not unduly reduced. The shape of the orifice can be varied to adjust the pattern of coverage of the rotary streams.

Rotary stream sprinklers have evolved over many decades. U.S. Pat. No. 1,764,570 granted to J. C. Lohman on Jun. 17, 1930 discloses a sprinkler with an inverted frusto-conical body with a series of longitudinally and spirally extending flutes. Streams of water passing upwardly through an annular series of apertures are directed against the flutes and cause the body to rotate. The rotary stream sprinkler of Lohman can be used with an underground irrigation system. U.S. Pat. No. 2,493,595 granted Jan. 3, 1950 to N. M. Rieger discloses a similar rotary stream sprinkler adapted for hose-end use.

U.S. Pat. No. 3,854,664 granted Dec. 17, 1974 to Edwin J. Hunter discloses a sprinkler with a rotating head that directs a plurality of rotating streams over an area to be watered. The streams are formed in nozzles in the rotating head. The rotating head has inlets to the nozzles on one end with cooperate with a keyed orifice plate which acts as a valve for communicating water to the nozzles. Orifice plates with various types of openings may be substituted to obtain any desired spray pattern. An impeller is actuated by the water flow to rotate the nozzle through a transmission.

U.S. Pat. No. 4,471,908 granted Sep. 18, 1984 to Edwin J. Hunter discloses a similar sprinkler having V-shaped nozzles in a cylindrical rotating head. The nozzle inlet openings cooperate with an orifice plate to vary the nozzle openings to the source of pressurized water, delivering streams of varying length and volume from the rotating head. The orifice in the plate defines the spray pattern to be produced by the streams issuing from the nozzles in the rotating head.

U.S. Pat. No. 4,815,662 granted Mar. 28, 1989 to Edwin J. Hunter discloses a rotary stream sprinkler with a damping device connected to the rotary head for controlling the rotational velocity of the head. U.S. Pat. No. 4,842,201 granted Jun. 27, 1989 to Edwin J. Hunter discloses a rotary stream sprinkler in which one or more arcuate passages are configured to control the volume and pressure of primary stream of water delivered to rotary distributing head.

U.S. Pat. No. 4,867,379 granted Sep. 19, 1989 to Edwin J. Hunter discloses a rotary stream sprinkler with a multi-passage flow control unit. U.S. Pat. No. 4,898,332 granted Feb. 6, 1990 to Edwin J. Hunter discloses a rotary stream sprinkler with a flow control unit having a variable restriction in a passage to or more arcuate passages. See also U.S. Pat. Nos. 4,932,590; 4,967,961; and 4,971,250, all granted to Edwin J. Hunter.

More recently U.S. Pat. No. 6,651,905 granted Nov. 25, 2003 to George Sesser et al. discloses an adjustable arc rotary stream sprinkler that includes an arc adjustment ring rotatably mounted on a base for rotating the nozzle relative to a stem for adjusting the arcuate discharge orifice. A throttle member is secured to the upstream end of a shaft such that rotation of the shaft causes the throttle to move relative to a portion of the stem, thereby adjusting the flow rate through the nozzle.

The type, placement and precipitation rates for the sprinklers of an irrigation system are usually selected when the system is designed or installed by a contractor. The goal is to uniformly distribute the optimum amount of water over a given area. The optimum precipitation rate provided by each sprinkler should preferably fall within plus or minus one-quarter GPM. The precipitation rate of a sprinkler is largely determined by the size and configuration of its nozzle orifice(s), although variations result from fluctuations in water pressure that cannot be fully negated with pressure regulators.

There is an ever growing need to conserve water, particularly in the Western United States. The watering program of an irrigation controller can also be optimized to ensure green turf and landscaping are maintained while using the minimum amount of water. In some cases, irrigation controllers are augmented with rain interrupt sensors and evapotranspiration data to modify their cycle and run times to accommodate weather changes. The amount of water conservation achievable through the design and dynamic re-programming of the irrigation controller has nearly been exhausted. Therefore, it is time to re-direct attention to the efficiency of the sprinklers themselves. Conventional rotary stream sprinklers typically distribute one to two GPM over an area approximately sixty feet wide.

It would be desirable to provide an improved rotary stream sprinkler that could uniformly water a relatively large area with substantially less water than conventional rotary stream sprinklers. Such a rotary stream sprinkler could also be used in place of multiple spray-type sprinklers and small rotor-type sprinklers and multiple valves. Such a sprinkler should have the capability for precisely tailoring its water distribution pattern including its shape and size.

SUMMARY OF THE INVENTION

In accordance with one aspect of my invention, a sprinkler includes a riser having an inlet end and an outlet end. The sprinkler has a nozzle having a plurality of a plurality of circumferentially spaced, radially extending stream forming slots. A drive assembly mounted in the riser has an output shaft that rotatably supports the nozzle at the outlet end of the riser. An impeller is coupled to an input shaft of the drive assembly. An orifice member is mounted adjacent the outlet end of the riser and has an orifice shaped to deliver water flowing through the riser into the stream forming slots in a manner that produces a predetermined water distribution pattern. The sprinkler further includes a rotatably adjustable deflector ring having a plurality of projections for intercepting streams of water ejected from the stream forming slots to vary a reach thereof.

In accordance with another aspect of my invention, a sprinkler includes a riser having an inlet end and an outlet end. A nozzle is rotatably supported at the outlet end of the riser and has a plurality of circumferentially spaced, radially extending stream forming slots. An orifice member is removably mounted adjacent the outlet end of the riser and has an orifice shaped to deliver water flowing through the riser into the stream forming slots in a manner that produces a predetermined water distribution pattern. A rotatably adjustable deflector ring is configured and mounted for intercepting streams of water ejected from the stream forming slots to vary a reach thereof.

DESCRIPTION OF THE PREFERRED EMBODIMENTS

Figure 1:
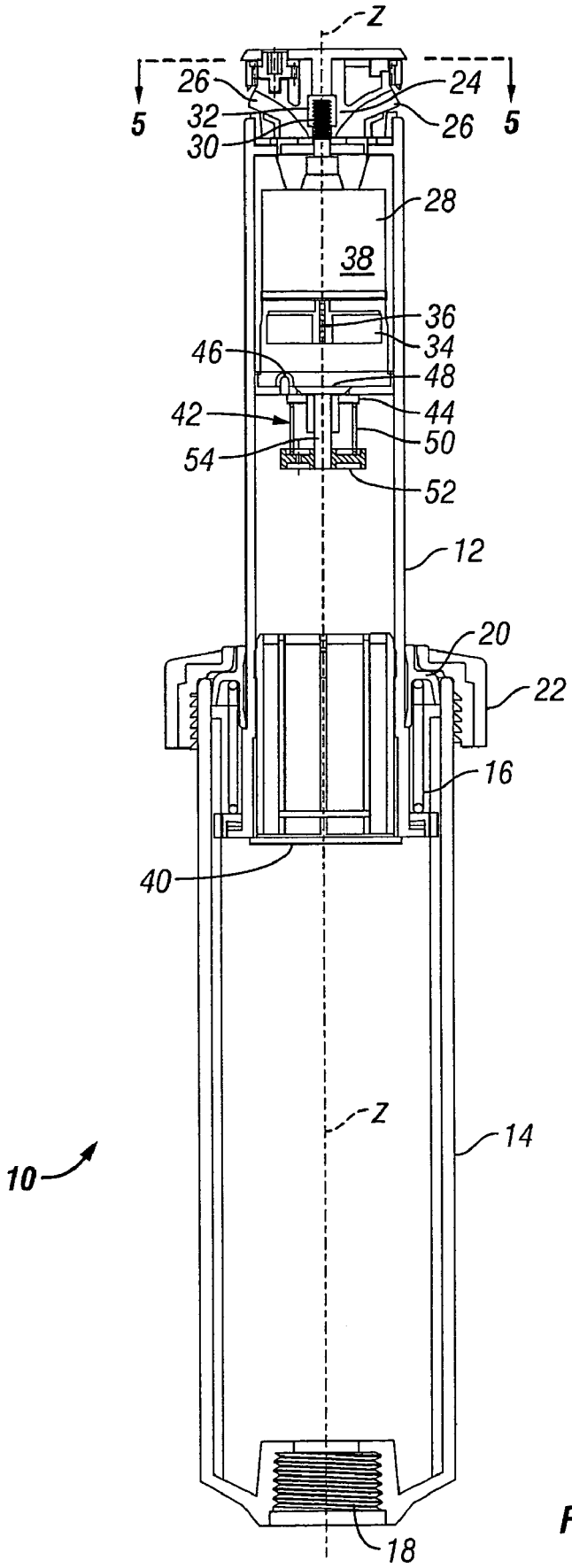
FIG. 1 is a vertical sectional view of a pop-up rotary stream sprinkler in accordance with a preferred embodiment of the present invention. The sprinkler riser is illustrated in its extended position.
Figure 2:
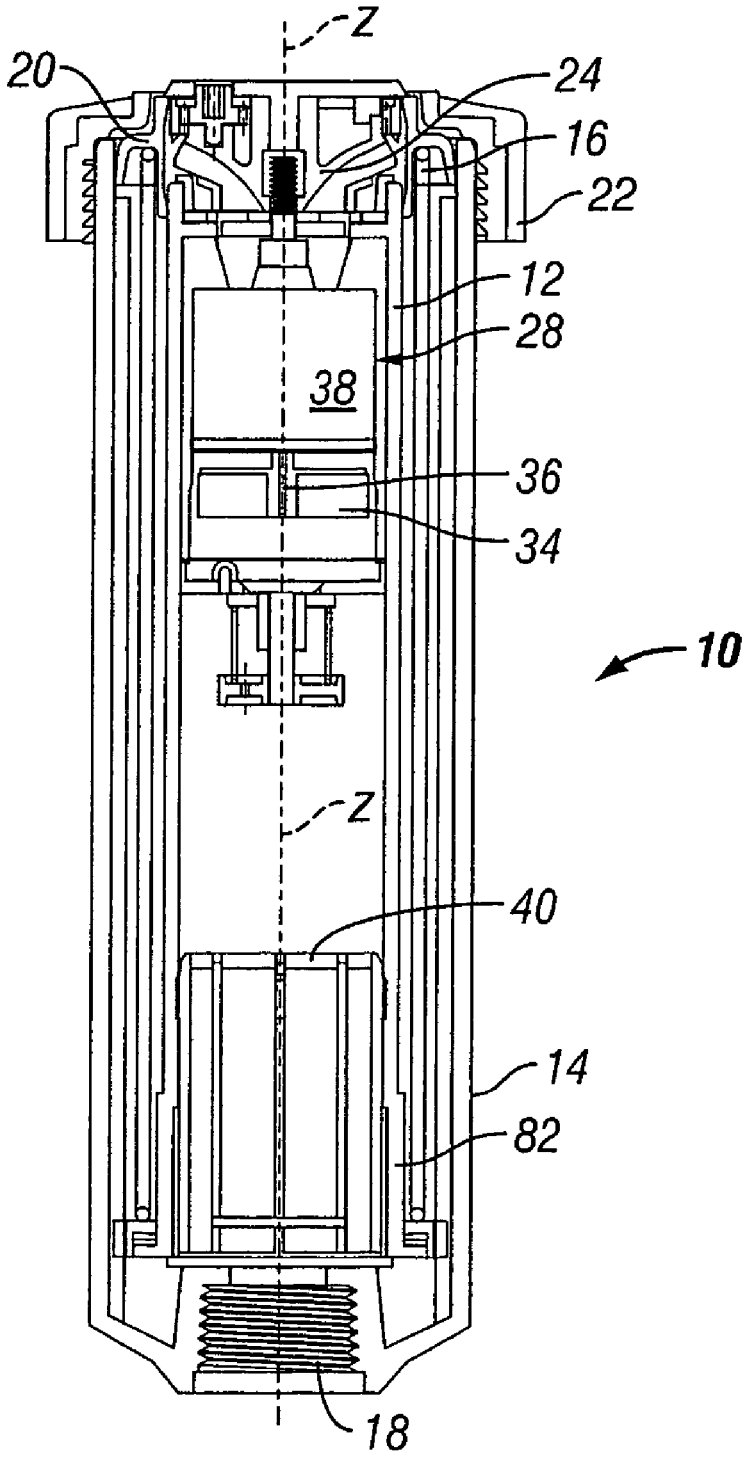
FIG. 2 is a view similar to FIG. 1 with the riser in its retracted position.

Unless otherwise indicated, the sprinklers hereafter described are made of molded plastic parts. Referring to FIGS. 1 and 2, a pop-up rotary stream sprinkler 10 includes a tubular riser 12 having an upper outlet end and a lower inlet end. A cylindrical outer body 14 surrounds and telescopically receives the riser 12. A large steel coil spring 16 surrounds the riser 12 and is compressed within the outer body 14 between a lower female threaded cylindrical inlet 18 and an upper elastomeric seal 20. The coil spring 16 is held in place by a threaded cap 22 screwed over a male threaded segment at the upper end of the outer body 14. The coil spring 16 biases the riser 12 to a retracted position illustrated in FIG. 2 within the outer body 14. The riser moves up to its extended position illustrated in FIG. 1 when pressurized water is supplied through the inlet 18 of the outer body 14.

Figure 3:
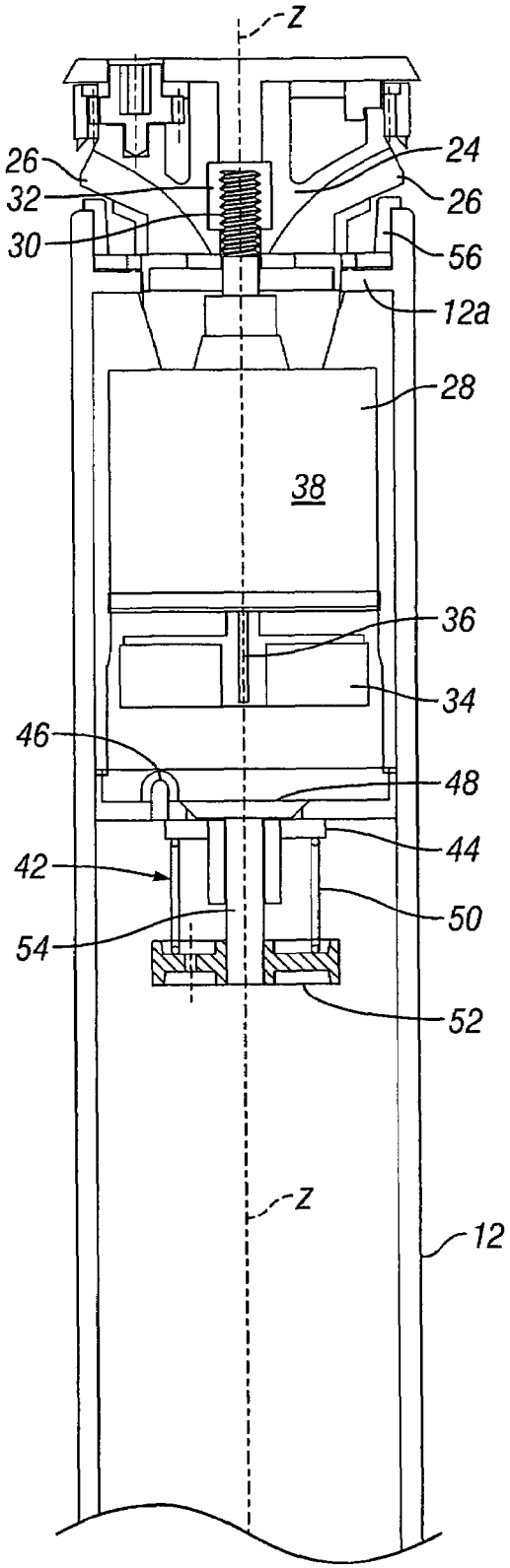
FIG. 3 is an enlarged portion of FIG. 1 showing details of the nozzle, drive assembly, impeller and speed regulator of the sprinkler.
Figure 4:
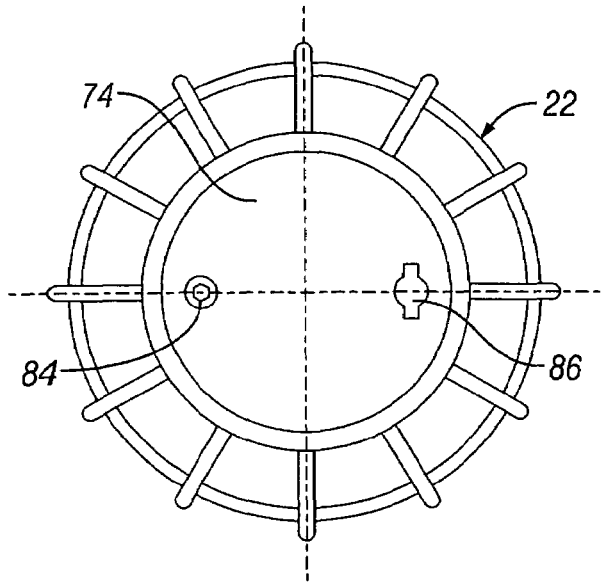
FIG. 4 is a top plan view of the sprinkler of FIG. 1.
Figure 7:
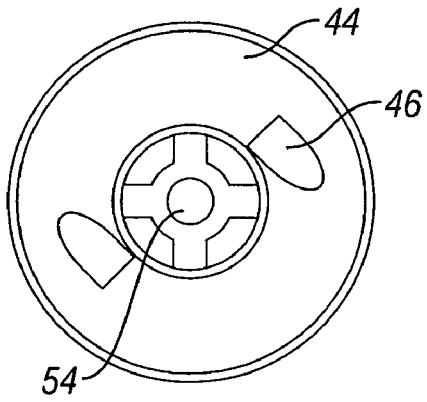
FIG. 7 is a top plan view of the stator housing of the sprinkler of FIG. 1.

A nozzle 24 (FIGS. 1 and 3) is rotatably mounted at the upper outlet end of the riser 12 for rotation about a vertical central axis Z. The nozzle 24 has six equally circumferentially spaced, identical, radially extending stream forming slots 26. The stream forming slots 26 have curved upper walls and are generally upwardly inclined. A drive assembly 28 is mounted in the riser 12 and has a threaded steel output shaft 30 that screws into a brass insert 32 seated in a central bore of the nozzle 24. An impeller 34 with spiral shaped vanes is coupled to a steel input shaft 36 of the drive assembly 28. The drive assembly 28 includes a two thousand-to-one reduction gear train (not illustrated) sealed within a cylindrical outer housing 38 that has an outer diameter slightly smaller than the inner diameter of the riser 12. Water flowing through the inlet 18 passes through a filter screen 40 (FIG. 1) mounted in the lower inlet end of the riser 12 and then through a speed regulator 42 that maintains a speed of rotation of the nozzle 24 substantially constant regardless of variations in water pressure. The water impinges against the periphery of the impeller 34 before passing through an annular gap between the drive assembly housing 38 and the inner wall of the riser 12. The speed regulator 42 includes a stator housing 44 with a pair of oppositely directed vent ports 46 (FIGS. 3 and 7). The speed regulator includes a speed control valve 48 (FIG. 3) that reciprocates up and down to progressively open a port in the stator housing 44. The speed control valve 48 is biased to its retracted closed position by a small metal coil spring 50 whose lower end is captured by a spring retainer 52 coupled to the central shaft 54 of the speed control valve 48.

Figure 9A:
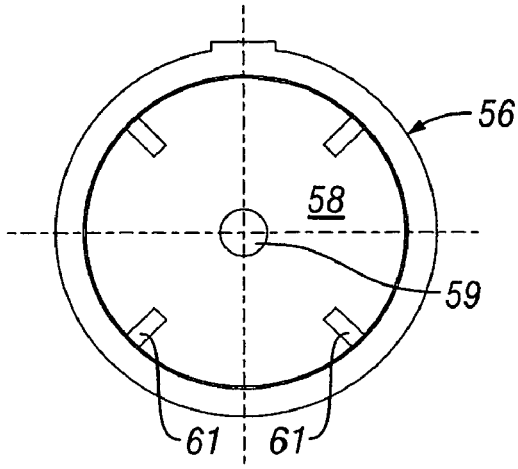
FIGS. 9A, 9B, and 9C are top plan, vertical sectional and bottom plan views, respectively, of an orifice member used in the sprinkler of FIGS. 1 and 2.
Figure 9B:
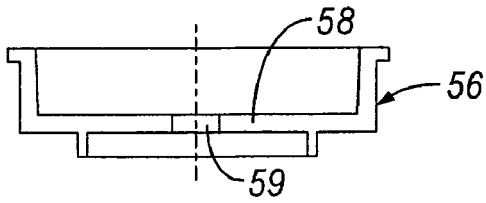
Figure 9C:
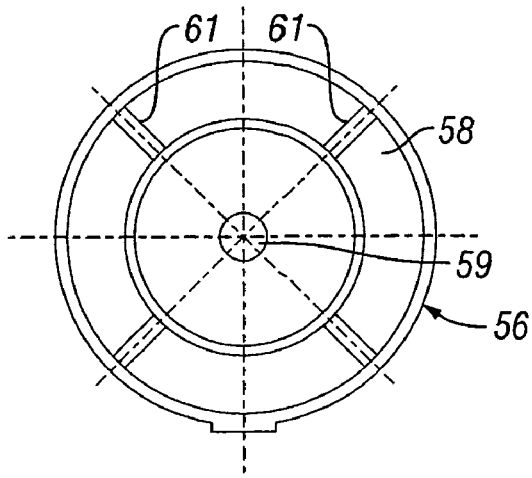
Figure 10:
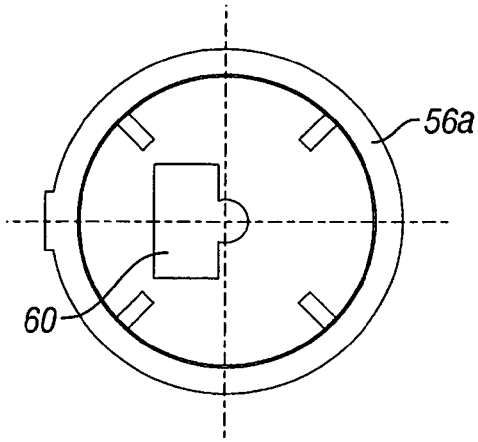
FIGS. 10-16 illustrate alternate forms of the orifice member.
Figure 11:
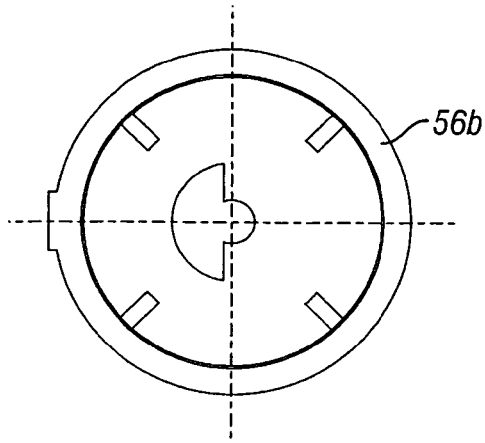
Figure 12:
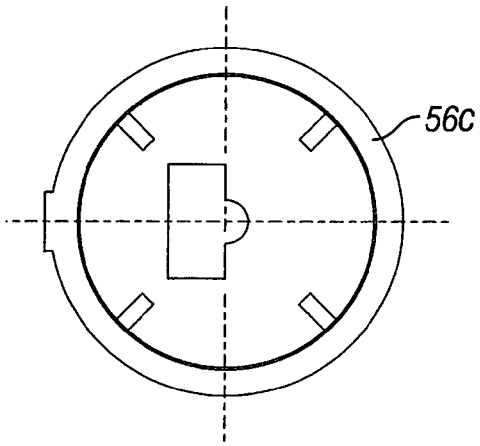
Figure 13:
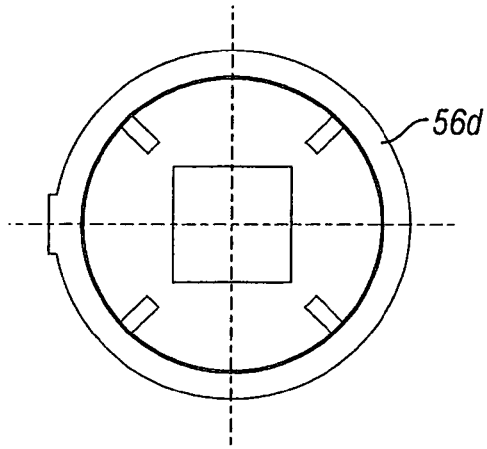
Figure 14:
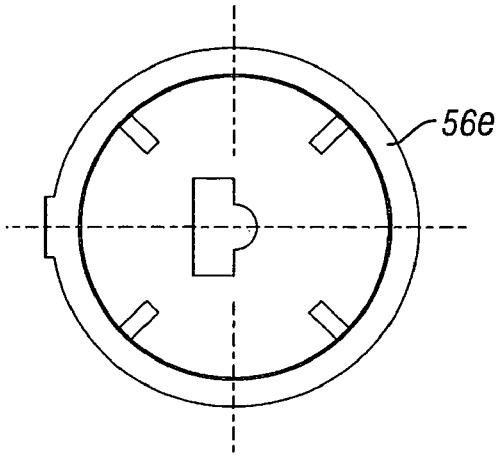
Figure 15:
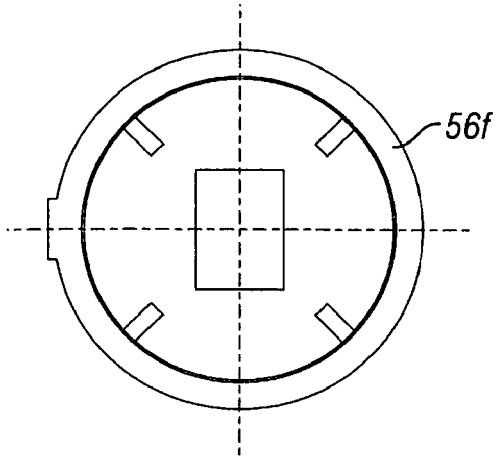
Figure 16:
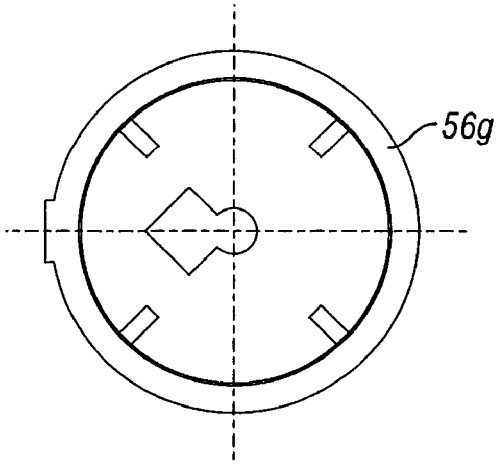

A generally cylindrical orifice member 56 (FIGS. 9A-9C) is mounted adjacent the outlet end of the riser 12. The orifice member 56 has a disk-shaped portion 58 in which an orifice such as rectangular orifice 60 (FIG. 10) can be formed. The particular orifice in the disk-shaped portion 58 is shaped to deliver water flowing through the riser 12 into the stream forming slots 26 in the nozzle 24 in a manner that produces a predetermined water distribution pattern, e.g. square, half-circle, etc. The orifice member 56 is made of a pliable plastic material such as polypropylene, polyethylene or a blend of the same. This type of relatively soft plastic material allows an installer to readily configure the shape of the orifice 60 with scissors. FIGS. 10-16 illustrate alternate forms of the orifice member 56*a*-56*g* with different orifice patterns including offset rectangles of different sizes, a centered rectangle, a centered square and an offset arcuate orifice. Each different orifice member, with its unique orifice pattern, may be readily identified by molding the same out of a unique brightly-colored plastic. The flat, transversely extending disk-shaped portion 58 of the orifice members has a small central hole 59 (FIG. 9A) for the output shaft 30 of the drive assembly 28. The disk shaped portion 58 with only the shaft aperture 59 may be cut with scissors by an installer to achieve a custom water distribution pattern. Each orifice member 56 has several alignment apertures 61 (FIGS. 9A and 9C) formed in the disk-shaped portion 58 which register with small keys (not visible) formed in a flange 12*a* at the upper end of the riser 12 that supports the orifice member 56.

Figure 5:
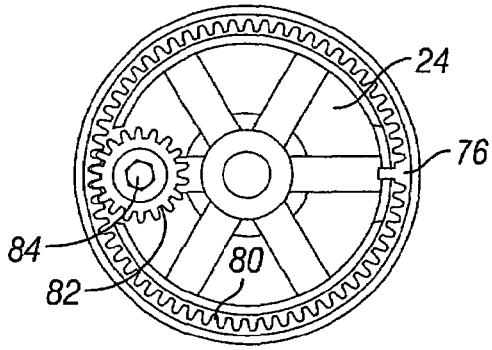
FIG. 5. is a horizontal sectional view of the sprinkler taken along line 5-5 of FIG. 1 illustrating the ring gear and pinion gear used to adjust the rotary position of the deflector ring of the sprinkler.
Figure 6:
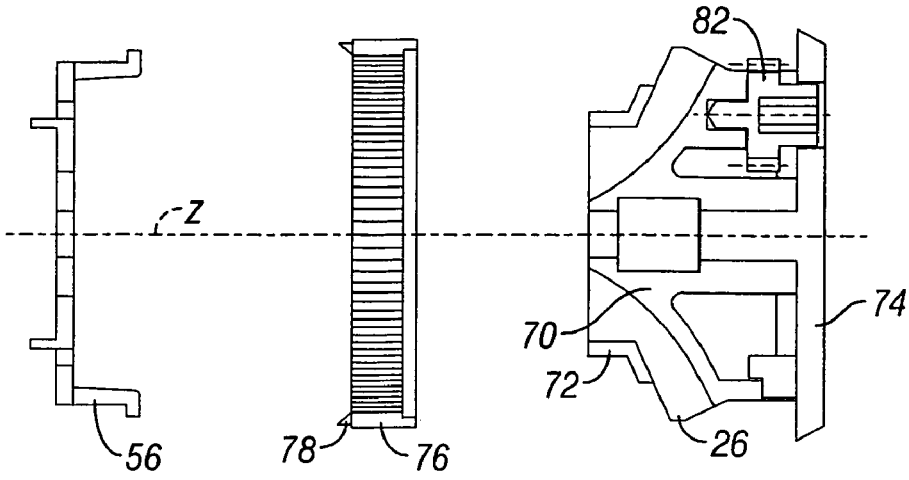
FIG. 6 is an enlarged exploded side elevation view of the nozzle, deflector ring, and orifice member of the sprinkler of FIG. 1.
Figure 8:
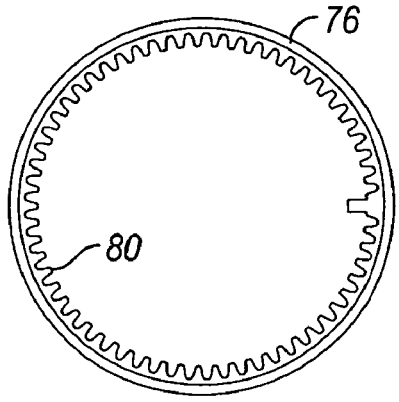
FIG. 8 is an enlarged bottom plan view of the deflector ring of the sprinkler of FIG. 1.
Figure 17:
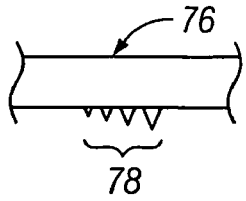
FIG. 17 is an enlarged fragmentary view illustrating a set of stream intercepting projections of the adjustable deflector ring of the sprinkler of FIGS. 1 and 2.

The peripheral lip of the brightly colored orifice member 56 is visible between the black colored riser 12 and the black colored nozzle 24 when the sprinkler 10 is fully assembled and the riser 12 extended as illustrated in FIG. 1. Thus, the expected water distribution pattern of the sprinkler 10 can be easily identified by pulling up the riser 12 with the standard HUNTER® arc adjustment tool when the water is turned OFF. The HUNTER® arc adjustment tool is disclosed in FIG. 8 of U.S. Pat. No. 6,042,021 granted Mar. 28, 2000 to Mike Clark and assigned to Hunter The nozzle 24 (FIG. 6) includes a nozzle body 70 sandwiched between a lower nozzle collar 72 and an upper nozzle top 74. A rotatably adjustable deflector ring 76 is mounted on, and surrounds, the nozzle body 70. The deflector ring 76 has a plurality of downwardly extending projections 78 for intercepting streams of water ejected from the stream forming slots 26 to vary a reach thereof. The deflector ring 76 preferably has six equally circumferentially spaced sets of projections 78. Each set of projections 78 corresponds to one of the stream forming slots 26. Each set of projections 78 (FIG. 17) includes four inverted V-shaped projections having progressive vertical lengths (along the Z axis). The spacing, length, shape and number of projections 78 in each set can be varied to achieve the desired adjustability of the throw of the water streams. A ring gear 80 (FIG. 8) is formed on an interior surface of the deflector ring 76. A pinion gear 82 (FIG. 5) is rotatably supported in a socket formed in the nozzle top 74 and is engaged with the ring gear 80. The pinion gear 82 has a hexagonal-shaped socket 84 (FIG. 7) that can be engaged by a standard HUNTER® arc adjustment tool to incrementally rotate the deflector ring 76 to move various ones of its projections 78 into intercepting relationship with the stream of water being ejected from the corresponding stream forming slot 26. The further down the projections 78 extend into the water streams, the shorter their reach or throw will become. When multiple projections 78 of varying lengths intercept the same stream of water the stream is diffused in such a manner as to ensure close-in and medium range coverage.

The nozzle 24 can also be screwed up and down on the output shaft 30 to vary a spacing between the stream forming slots 26 and the orifice member 56. The orifice member 56 is readily replaceable by completely unscrewing the nozzle 24 from the shaft 30 so that another orifice member 56 with a different shaped orifice 60 can be installed. When the sprinkler 10 is fully assembled and the water is OFF, the HUNTER® arc adjustment tool can be inserted into a key-hole shaped aperture 86 (FIG. 7) in the nozzle top 74, twisted ninety degrees, and pulled upwardly to raise the riser 12 to its extended position to permit replacement of the orifice member 56.

My sprinkler 10 can be designed to uniformly deliver one-quarter inch of water per hour over a rectangular area measuring sixty feet by sixty feet. The orifice 60 in the orifice member 56 can be cut so that all six stream forming slots 26 simultaneously eject water over a square plot. Watering a half-square plot only requires that three of the stream forming slots 26 eject water at the same time. Watering a one-quarter square plot requires that only a single one of the stream forming slots 26 eject water at a time. A ratchet mechanism 88 (FIG. 2) at the lower end of the riser 12 allows the riser 12 to be rotated relative to the outer body 14 to adjust the direction of ejection of the water streams in the case where less than all six of the stream forming slots 26 simultaneously eject water. The ratchet mechanism 88 preferably comprises a plurality of radially extending vanes on the lower end of the riser 12 that deflect past radially inwardly directed teeth molded into the interior surface of the outer body 14.

Figure 18:
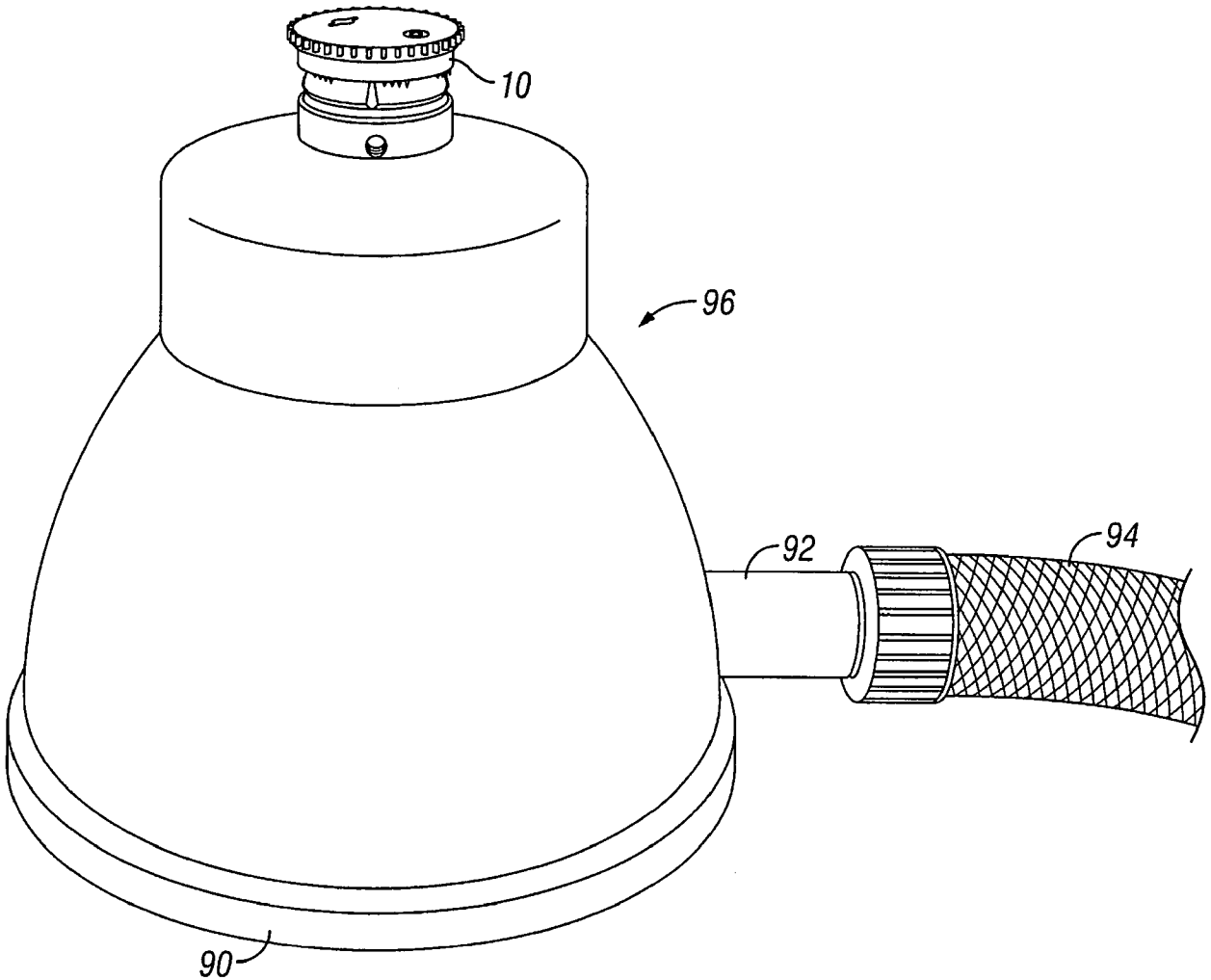
FIG. 18 is a perspective view of a hose end sprinkler incorporating the rotary stream sprinkler of FIGS. 1 and 2.

Referring to FIG. 18, my sprinkler 10 may be mounted within a stylized plastic base 90 with a female fitting 92. The fitting 92 can be screwed over the male fitting of a garden hose 94. Inside the base 90 the fitting 92 is connected to the sprinkler 10 so that the assembly provides a hose end sprinkler 96. This provides an alternative to the normal subterranean mounting of my sprinkler 10.

While I have described two embodiments of my rotary stream sprinkler 10, it will be apparent to those skilled in the art that my invention can be further modified in both arrangement and detail. For example, the nozzle 24 and deflector ring 76 could be designed to be screwed onto the upper end of a fixed or telescoping riser. The number and shape of the stream forming slots 26 could be varied. The stream forming slots 26 could be angled to self-propel the nozzle and thereby eliminate the need for the drive assembly and the impeller. A damper or friction plate could be included to limit the rotational speed of the nozzle where it is self-propelled in lieu of the impeller 34 and drive assembly 28 illustrated in FIGS. 1-3. The configurations of the deflector ring 76 and its projections 78 can be greatly varied. Therefore, the protection afforded my invention should only be limited in accordance with the following claims.

I claim:

1. A sprinkler, comprising:

a riser having an inlet end and an outlet end;

a nozzle having a plurality of circumferentially spaced, radially extending stream forming slots;

a drive assembly mounted in the riser having an output shaft rotatably supporting the nozzle at the outlet end of the riser;

an impeller coupled to an input shaft of the drive assembly;

an orifice member mounted adjacent the outlet end of the riser having an orifice shaped to deliver water flowing through the riser into the stream forming slots in a manner that produces a predetermined water distribution pattern;

a rotatably adjustable deflector ring having a plurality of projections for intercepting streams of water ejected from the stream forming slots to vary a reach thereof; and a ring gear formed on an interior surface of the deflector ring and a pinion gear rotatably supported by the nozzle and engaged with the ring gear, the pinion gear being rotatable by a tool to rotate the deflector ring.

2. The sprinkler of claim 1 and further comprising a speed regulator for maintaining a speed of rotation of the nozzle substantially constant regardless of variations in water pressure.

3. The sprinkler of claim 1 and further comprising an outer body surrounding and telescopically receiving the riser, and a coil spring surrounding the riser and biasing the riser to a retracted position within said body.

4. The sprinkler of claim 1 wherein the nozzle includes a nozzle body sandwiched between a nozzle collar and a nozzle top.

5. The sprinkler of claim 1 wherein the deflector ring includes a plurality of sets of projections, each set corresponding to a stream forming slot, and each set including projections having progressive lengths.

6. The sprinkler of claim 1 wherein the orifice member has a disk-shaped portion in which the orifice is formed.

7. The sprinkler of claim 1 wherein the orifice member is made of a pliable plastic material that allows a shape of the orifice to be configured with scissors.

8. The sprinkler of claim 1 wherein the output shaft of the drive assembly is threaded and the nozzle can be screwed up and down on the output shaft to vary a spacing between the stream forming slots and the orifice member.

9. The sprinkler of claim 8 wherein the orifice member is replaceable by completely unscrewing the nozzle.

10. A sprinkler, comprising:

a riser having an inlet end and an outlet end;

a nozzle rotatably supported at the outlet end of the riser and having a plurality of circumferentially spaced, radially extending stream forming slots;

an orifice member removably mounted adjacent the outlet end of the riser having an orifice shaped to deliver water flowing through the riser into the stream forming slots in a manner that produces a predetermined water distribution pattern;

a rotatably adjustable deflector ring configured and mounted for intercepting streams of water ejected from the stream forming slots to vary a reach thereof; and a ring gear formed on an interior surface of the deflector ring and a pinion gear rotatably supported by the nozzle and engaged with the ring gear, the pinion gear being rotatable by a tool to rotate the deflector ring.

11. The sprinkler of claim 10 and further comprising a drive assembly mounted in the riser and having an output shaft rotatably supporting the nozzle at the outlet end of the riser.

12. The sprinkler of claim 11 and further comprising an impeller coupled to an input shaft of the drive assembly.

13. The sprinkler of claim 12 and further comprising a speed regulator for maintaining a speed of rotation of the nozzle substantially constant regardless of variations in water pressure.

14. The sprinkler of claim 10 wherein the nozzle includes a nozzle body sandwiched between a nozzle collar and a nozzle top.

15. The sprinkler of claim 10 wherein the deflector ring includes a plurality of sets of projections, each set corresponding to a stream forming slot, and each set including projections having progressive lengths.

16. The sprinkler of claim 10 wherein the orifice member has a disk-shaped portion in which the orifice is formed.

17. The sprinkler of claim 10 wherein the orifice member is made of a pliable plastic material that allows a shape of the orifice to be configured with scissors.

18. A sprinkler, comprising:

a riser having an inlet end and an outlet end;

an outer body surrounding and telescopically receiving the riser;

a coil spring surrounding the riser and biasing the riser to a retracted position within said body;

a cap screwed over an upper end of the outer body for retaining the coil spring;

a nozzle having a plurality of circumferentially spaced, radially extending stream forming slots;

a drive assembly mounted in the riser having an output shaft rotatably supporting the nozzle at the outlet end of the riser;

an impeller coupled to an input shaft of the drive assembly;

an orifice member mounted adjacent the outlet end of the riser having an orifice shaped to deliver water flowing through the riser into the stream forming slots in a manner that produces a predetermined water distribution pattern;

a rotatably adjustable deflector ring mounted on the nozzle and having a plurality of projections for intercepting streams of water ejected from the stream forming slots to vary a reach thereof, including a ring gear formed on an interior surface of the deflector ring;

a pinion gear rotatably supported by the nozzle and engaged with the ring gear, the pinion gear being rotatable by a tool to rotate the deflector ring; and a speed regulator for maintaining a speed of rotation of the nozzle substantially constant regardless of variations in water pressure.

* * * * *